US005495401A

United States Patent [19]

Evans

[11] Patent Number: 5,495,401

[45] Date of Patent: Feb. 27, 1996

[54] DISTANCE LIGHTING SYSTEM FOR BOATS

[76] Inventor: Graham P. Evans, 500 Duplex Ave., Suite 2304, Toronto, Ontario, Canada, M4R 1V6

[21] Appl. No.: 302,126

[22] Filed: Sep. 7, 1994

[51] Int. Cl.[6] ..... B63B 45/00

[52] U.S. Cl. ..... 362/61; 362/84; 362/234; 362/225; 116/26

[58] Field of Search ..... 114/343; 362/61, 362/83.3, 84, 234, 231, 251, 252, 225; 116/26

[56] References Cited

U.S. PATENT DOCUMENTS

| | | | |
|---|---|---|---|
| 2,704,321 | 3/1955 | Orlansky | 240/7.7 |
| 2,808,502 | 10/1957 | Large | 240/8.2 |
| 3,723,722 | 3/1973 | Van Iderstine et al. | 240/7.7 |
| 4,128,332 | 12/1978 | Rowe | 355/67 |
| 4,613,927 | 9/1986 | Brandt | 362/32 |
| 4,740,870 | 4/1988 | Moore et al. | 362/32 |
| 4,901,209 | 2/1990 | Nitz | 362/72 |
| 4,947,293 | 8/1990 | Johnson et al. | 362/32 |
| 4,954,931 | 9/1990 | Hassler et al. | 362/32 |
| 5,416,670 | 5/1995 | Authier | 362/34 |

*Primary Examiner*—Stephen F. Husar
*Attorney, Agent, or Firm*—Sim & McBurney

[57] ABSTRACT

A distance safety lighting system for boats, comprising three electroluminescent strips disposed in the bumper guard surrounding the gunwale of a boat so as to form a substantially continuous illuminated loop around the boat. Preferably, a red strip extends along the port side of the boat, a green strip extends along the starboard side of the boat, and a white strip extends along the stern of the boat. The three-colored illuminated strips provide a visually discernable profile of the boat for identification at night.

7 Claims, 2 Drawing Sheets

DISTANCE LIGHTING SYSTEM FOR BOATS

FIELD OF THE INVENTION

This invention relates in general to lighting systems, and more particularly to a distance safety lighting system for night identification of boats.

BACKGROUND OF THE INVENTION

In an effort to reduce the likelihood of boating accidents after dark, government legislation in most countries stipulates mandatory use of navigational lights on boats. The standard configuration of lights comprises a single light mounted at the bow of a boat having a green lens on the starboard side and a red lens on the port side, and a single white light located at the stern of the boat.

In spite of the mandatory use of such navigational lights, it has been found that night time accidents between recreational boating vehicles is still frequent. One possible cause for the large number of collisions between boats operating at night is the almost complete inability of the boat operator to detect depth-of-field and the consequent inability to ascertain distance from and orientation of an oncoming boat. For example, instances are known in which boat operators have mistaken the navigational lights of another boat as being lights located on shore, and have collided with the other boat as a result. In such instances, the boat operators have experienced difficulties recognizing other marine traffic when relying only on the relative light and darkness provided by pin point navigational lights (i.e. essentially a two-dimensional frame of reference).

Also, both the bow and stern lights of present navigation lighting systems are known to generate glare which affects the night vision of the boat operator, both through the boat windshield and above it. In this regard, the stern light is the greatest offender since glare from the stern light is projected in all directions. Furthermore, the laws require that the stern light be raised on a pedestal which consequently increases the glare. If glare from the bow or stern lights is excessive, a boat operator's night vision may temporarily be lost which can result in an accident. In an effort to overcome the problem of glare using prior art navigation lights, operators have been known to tape the front half of the stern light in order to prevent forward shining glare from the stern light. However, taping of the front half of the stern light effectively renders the stern light invisible to other boats approaching from the bow. The stern light is therefore no longer easily visible which contributes to further confusion of other operators as to the direction of travel of the boat.

Prior art systems are known for enhancing the visibility of marine and land vehicles at night. For example, U.S. Pat. No. 4,947,293 (Johnson et al) discloses a perimeter clearing lighting system for use with tractor-trailer trucks. U.S. Pat. No. 3,723,722 (Van Inderstine et al) discloses a rotary wing mounted lighting system for helicopters. U.S. Pat. No. 4,613,927 (Brandt) discloses an elevated signal indicator for automobiles. U.S. Pat. No. 4,901,209 (Nitz) discloses an illuminated frame for bicycles. U.S. Pat. No. 4,740,870 (Moore et al) discloses a distributed lighting system for boats. U.S. Pat. No. 2,704,321 (Orlansky) discloses an illuminating system for the trailing edges of aircraft.

Various ones of the known prior art systems teach the use of distributed light in conjunction with standardized colouring for navigation. However, none of the above-discussed references provide a complete solution to the problem of providing depth of field to a boat operator during night time operation.

SUMMARY OF THE INVENTION

According to the present invention, a distance safety lighting system is provided for enhanced recognition of marine traffic at night. The system is designed to compensate for lack of depth of field by allowing an operator to see and react to another boat using only relative light and darkness. According to an aspect of the present invention, a boat is framed with a continuous illuminated strip which allows the operator of another boat to assess the direction, speed, size, distance and orientation of the boat. At night, the strip appears as a continuous band of light which is virtually impossible to be mistaken for shore lighting. The horizontal length of the visible illuminated strip provides an indication of the angle of interception. A short length of light strip indicates a head-on (or rear-on) approach. Conversely, a long length of light strip indicates a broad side approach.

According to a preferred embodiment of the invention, three electroluminescent strips are embedded in the bumper guard surrounding the gunwale of the boat. Electroluminescent lamps are well known in the art and consist of a layer of phosphor crystal which is sandwiched between metal foil and a transparent electrode. According to the preferred embodiment, a red strip extends from the stern to the bow on the port side of the boat, a green strip extends from the stern to the bow on the starboard side of the boat, and a white strip extends across the stern.

Thus, according to the preferred embodiment, when approaching a boat equipped with the strip lighting system of the present invention from behind, the white electroluminescent strip can be easily seen thereby eliminating any doubt in the mind of the operator as to the angle of approach based on the relative lengths of green and white or white and red light strips.

The safety lighting system of the present invention provides the boat operator with an accurate assessment of the size of a vessel as well as its speed. This allows the operator ample time to compensate for the size of the wake being turned up by the recognized boat.

BRIEF DESCRIPTION OF THE DRAWINGS

A description of the preferred embodiment is provided herein below with reference to the following drawings, in which.

DETAILED DESCRIPTION OF THE PREFERRED EMBODIMENT

Figure 1:
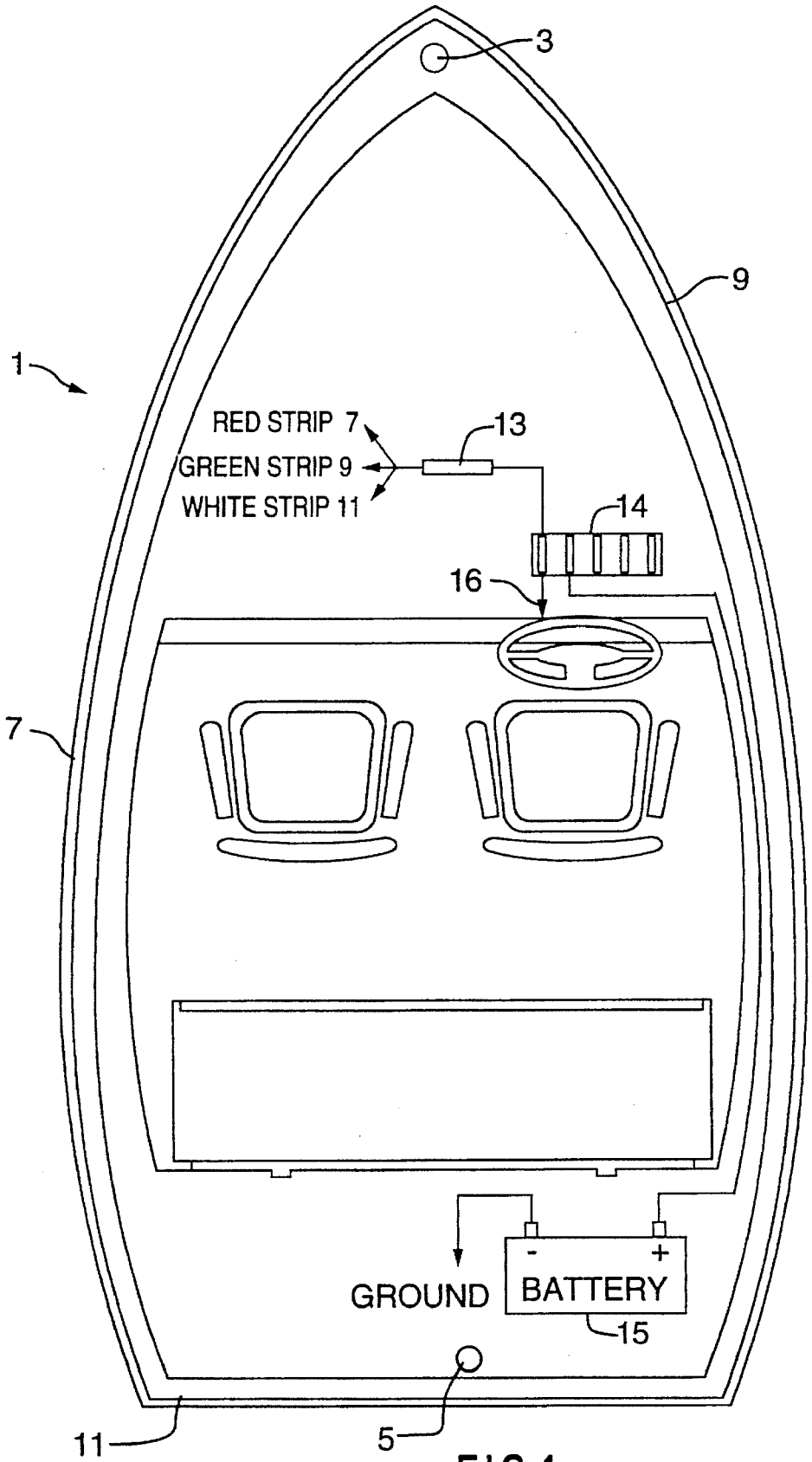
FIG. 1 is a plan view schematic representation of a boat equipped with the distance safety lighting system according to a preferred embodiment of the present invention.

With reference to FIG. 1, a boat 1 is shown provided with a well known navigation lighting system comprising a bow light 3 and elevated stern light 5. However, according to the present invention, the boat 1 is also provided with a distance safety lighting system comprising three coloured electroluminescent strips 7, 9 and 11 extending around the gunwale of the boat 1. In particular, according to the invention, electroluminescent strip 7 is coloured red and extends from the stern to the bow of the boat along the port side, electroluminescent strip 9 is coloured green and extends from the stern to the bow along the starboard side, and electroluminescent strip 11 is coloured white and extends between strips 7 and 9 across the stern of the boat 1. Thus, in accordance with the present invention, the profile of the boat 1 can be easily ascertained for navigation after dark.

In particular, in a head-on approach the electroluminescent strips are divided evenly in half with the green portion 9 visible to an oncoming boat on the left and red portion 7 on the right. To the operator of a boat which is approaching from ahead and from the starboard side, the red strip 7 is predominant over the green strip 9. If the boat is approaching from ahead and from the port side, the green strip 9 is predominant over the red strip 7. The degree of predominance (i.e. perceived length) of one colour over another provides an indication of the angle of approach, with equal colour lengths being indicative of a head-on collision. If the light appears entirely white, then the boat is travelling in the same direction as the viewer in a straight line directly off the bow. Likewise, combinations of red-white and green-white strips indicate that the viewer is heading toward the stern of a boat ahead of the viewer from its port side or starboard side, respectively. A full green or red light strip indicates a broadside approach to another boat from its starboard or port side, respectively.

The strips 7, 9 and 11 receive AC operating power from a plurality of DC-to-AC inverters 13, which are connected to the fuse box 14. The fuse box forms part of the standard electrical system of a power boat. DC operating power is generated from a 12 Volt battery 15 and is applied to the inverters 13 and all of the other electrical devices of the boat (e.g. standard navigation lights, horn, depth sounder, GPS, bilge pump, blower, etc.), in a well known manner. Of course, once the engine is running, battery charge is replenished via the engine alternator (not shown). An ignition 16 is also connected to the fuse box 14 in the usual manner. The details of the inverter circuitry are discussed in greater detail below with reference to FIG. 3.

Figure 2A:
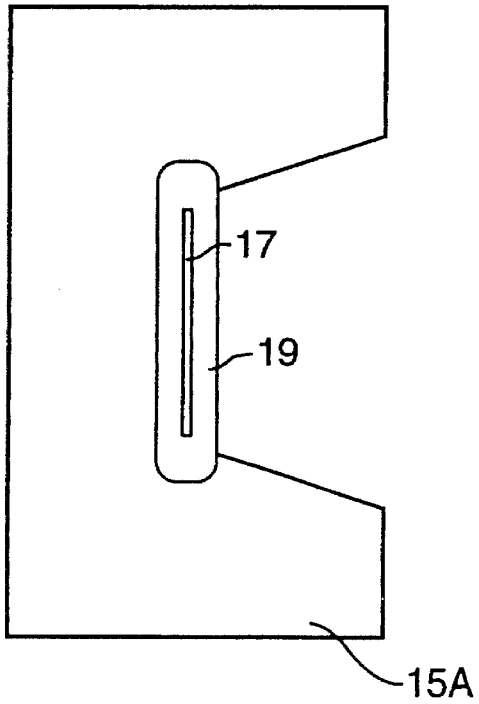
FIGS. 2A and 2B are cross section views (not to scale) of an electroluminescent strip installed within a first standard size bumper guard and a second standard size bumper guard, respectively, according to the preferred embodiment.
Figure 2B:
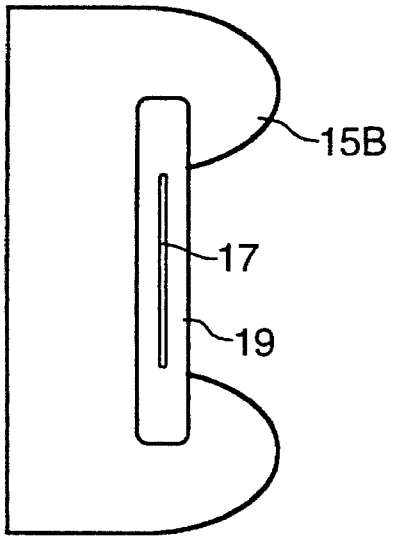

Turning to FIGS. 2A and 2B, cross-sectional views are shown through the electroluminescent strip and supporting structure according to the preferred embodiment. In FIG. 2A, a bumper guard 15A having a width of approximately 3.5 cm. and a depth of approximately 2.0 cm. is shown, whereas in FIG. 2B, a bumper guard 15B having a width of approximately 7.0 cm. and a depth of approximately 3.4 cm. is shown. The rectangular-trapezoidal cross-sectional profile of the bumper guard in FIG. 2A is typical of the style of this standard size of bumper guard, while the rounded B-shaped cross-sectional profile of the bumper guard of FIG. 2B is typical of the style of that standard size of bumper guard. It will be readily apparent to a person skilled in the art that the cross-sectional profiles of the bumper guards of FIG. 2 do not form part of the present invention, but are shown as illustrative embodiments only.

The resilient bumper guards 15A and 15B are preferably secured to the gunwales of the boat 1 (FIG. 1) via a metal frame (not shown), screws (not shown), or other well known fastening means. The bumper guards 15A and 15B may be made from hard rubber, polyethylene, or other suitable material.

In accordance with the preferred embodiment, bumper guards 15A and 15B are recessed so as to receive electroluminescent strip 17, which can be red, green, white (or other colour if desired), as discussed above. According to the best mode of this invention at the time of filing this application, the strips 7, 9 and 11 (shown generically in FIGS. 2A and 2B by reference numeral 17), are electroluminescent strip lighting lamps manufactured by E-Light Technologies Inc. of Stafford, Conn. This particular type of electroluminescent lamp differs from prior art electroluminescent lamps in that it is produced in a continuous coil form with a split electrode in the form of a line scribed down the centre of the aluminum back layer of the lamp, each of the two aluminum halves being connected in series electrically to form the main current distribution system for the lamp. The finished lamps are produced by simply cutting or stamping a desired length of coil strip, scribing and then terminating the strip with either pressure contacts, crimped terminals or wire leads connected to the inverters 13. The preferred strip lighting lamps operate off of 250 VAC power at 400 Hz, with a current consumption of 0.35 ma per square inch, and a capacitance of 0.35 nF per square inch. Different colours are obtained by using overlays or phosphors.

A surrounding flexible clear compound 19 protects the electroluminescent strip 17 from UV and moisture. The coating 19 is preferably injection moulded around the strip 17, but can also be co-extruded or laminated onto the strip. According to the best mode of the invention at the time of filing this application, the coating 19 is preferably ALPHA PVC 2215-85 CLEAR flexible PVC compound obtainable from Alpha Chemical and Plastics Corp., Newark, N.J., U.S.A., In the preferred embodiment, each of the strips 7, 9 and 11 is ¾", +/–0.005" wide and approximately 0.013" thick, with the red and green strips 7 and 9 each being 30' in length, and the white strip 11 being 10' in length. The wall thicknesses of the extruded jackets of coating 20 are approximately 0.070" creating an extruded final product having a thickness of 0.156" and a width of 0.890". It will be understood by a person skilled in the art that the width and thickness of the strip may vary depending on size and type of boat, etc.

Figure 3:
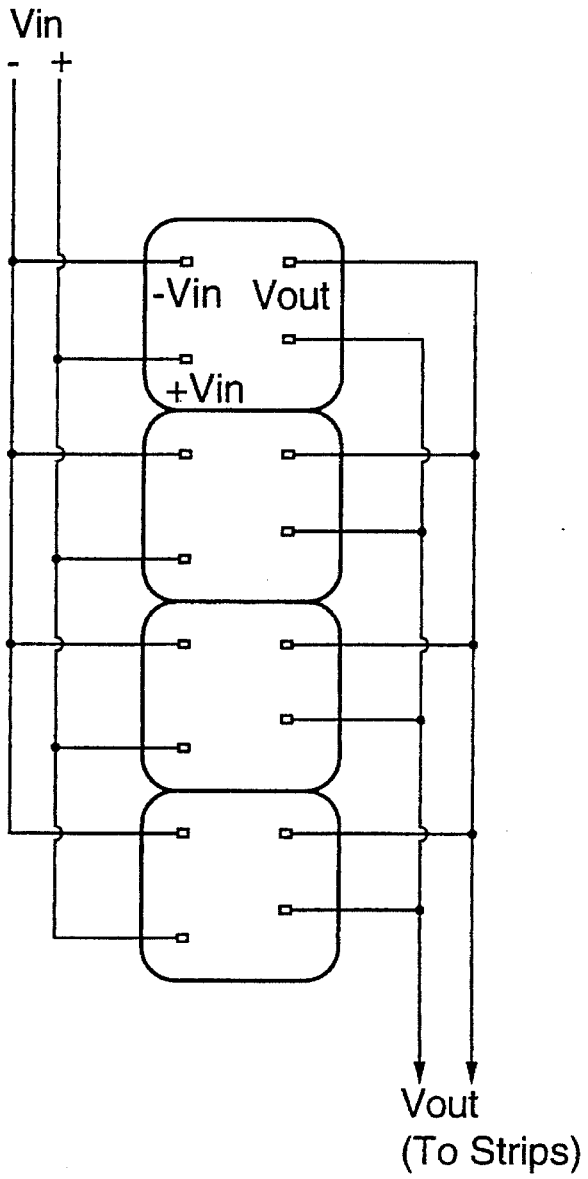
FIG. 3 is a block schematic diagram of four-out-of-eight parallel connected DC-to-AC converters of the circuitry shown in FIG. 1.

Turning finally to FIG. 3, four inverters 13A, 13B, 13C and 13D are shown connected in parallel to a DC terminal ($V_{in}$) from the fuse box 14 and to an output power bus ($V_{out}$). Although only four inverters are shown in FIG. 3 for clarity, according to the preferred embodiment eight such inverters are required to be connected in parallel to drive the three electroluminescent strips 7, 9 and 13, each strip being connected in series to the output power bus. According to the best mode of the invention at the time of filing this application, each inverter comprises a E743 standard DC to AC inverter in a "H" package, manufactured by Endicott Research Group, Inc. Each such inverter is capable of powering 96" of an electroluminescent strip from a 12 VDC battery at less than 0.5 mA, thereby requiring the use of eight such inverters (i.e. 8×96"=768"=64' (29' red, 29' green and 8' white, for a 28' boat which allows 1 foot per strip for safe water-tight sealed internal electrical connection, thereby preventing any ingress of water from outside the boat).

In summary, the distance safety lighting system of the present invention provides for instantaneous detection of the profile and size of a boat operating at night as a result of the continuously illuminated strips surrounding the boat. Also, the rate of change of the width of visible light from the electroluminescent strips provides an indication of the speed of approach. In addition, the system of the present invention permits an operator to accurately assess the size of the vessel and thereby compensate for the size of the wake being turned up by the vessel. Furthermore, the system of the present invention allows for easy determination of the angle of approach of another boat. It provides for better visibility in foggy conditions and results in reduced glare over prior art lighting systems. The safety lighting system of the present invention may be used as an alternative to or as an enhancement to well known standard navigation lights.

Other embodiments and variations of the invention are possible. For example, although the preferred embodiment incorporates three electroluminescent strips for navigation purposes, the advantages of the invention may be obtained using three optical cables illuminated by a light source such as a light engine, or a strip of high intensity point light sources (e.g. light emitting diodes). Alternatively, a single colour of electroluminescent strip or optical cable (e.g. white) may be used instead of three colours circumscribing the starboard side, port side and stern of the boat. In this alternative embodiment the advantage of being able to distinguish a vessel from shore lighting is obtained as in the three colour preferred embodiment, although the orientation of the vessel is more difficult to ascertain than when using the three-coloured version of the preferred embodiment.

According to another alternative embodiment, a light sensor and intermittent power circuit may be connected to the DC-to-AC inverters and the engine ignition, for detecting day and night boating conditions and enabling the electroluminescent strips intermittently at night, thereby ensuring that the boat may be seen even if it is adrift in the middle of a lake without the ignition on. In this embodiment, the intermittent power circuit ensures that intermittent activation of the electroluminescent strips does not drain the battery.

Also, whereas the preferred embodiment of FIG. 2A and 2B shows the electroluminescent strip encapsulated into a recess of the gunwale bumper guard, it is contemplated that the strip may be directly mounted to the boat gunwale, although the protective encapsulation of the strip within the bumper guard is preferred for protection from impact, rubbing etc.

Furthermore, the distance lighting system may be used on other than power boats. For example, by using a small, portable 12 volt power pack the system may be used on canoes, kayaks, small motor runabouts sailboats, DPs, etc.

All such modifications and variations are believed to be within the sphere and scope of the invention as defined by the claims appended hereto.

I claim:

1. A distance safety lighting system for a boat, comprising strip light means, means for powering said strip light means, and means for mounting said strip light means to said boat in a substantially continuous illuminated loop therearound, whereby said illuminated loop provides a visually discernible profile of said boat.

2. The lighting system of claim 1, wherein said strip light means is selectively coloured to identify different portions of the boat.

3. The lighting system of claim 2, wherein said strip light means comprises a first white electroluminescent strip lamp mounted across the stern of said boat, a second green electroluminescent strip lamp mounted along the starboard side of said boat, and a third red electroluminescent strip lamp mounted along the port side of said boat, whereby said mounting of said electroluminescent strip lamps facilitates remote detection of orientation of said boat.

4. The lighting system of claim 1, wherein said means for mounting comprises a bumper guard secured to the gunwale of said boat, said bumper guard having a recess therein for receiving said strip light means.

5. The lighting system of claim 1, further including a flexible clear water-proof coating surrounding said strip light means.

6. The lighting system of claim 3, wherein said means for powering said strip light means further comprises a DC power source and DC-to-AC inverter means for converting DC voltage to AC voltage at a predetermined frequency and current for powering said electroluminescent strip lamps.

7. The lighting system of claim 5, wherein said coating is a flexible PVC compound injection moulded around said strip light means for protecting said strip light means from moisture and ultraviolet radiation.

* * * * *